United States Patent [19]

Edwards et al.

[11] 4,129,910

[45] Dec. 19, 1978

[54] LAUNCHING SYSTEM FOR INFLATABLE RAFT

[75] Inventors: David V. Edwards, Goring-by-Sea, Worthington, England; Harvey B. Lesh, Jr., N. Canton; Ronald W. Phillips, II, Akron, both of Ohio

[73] Assignee: The B. F. Goodrich Company, Akron, Ohio

[21] Appl. No.: 831,585

[22] Filed: Sep. 8, 1977

Related U.S. Application Data

[63] Continuation-in-part of Ser. No. 777,501, Mar. 14, 1977, abandoned.

[51] Int. Cl.[2] ..... B63B 23/00

[52] U.S. Cl. ..... 9/42; 9/30; 9/32

[58] Field of Search ..... 9/3, 4 R, 4 A, 11 R, 9/11 A, 30–45, 1.6, 1.7

[56] References Cited

U.S. PATENT DOCUMENTS

| | | | |
|---|---|---|---|
| 2,544,794 | 3/1951 | Kelley | 9/11 R |
| 2,970,324 | 2/1961 | Phillips | 9/11 A |
| 3,222,700 | 12/1965 | Smith | 9/11 A |
| 3,284,822 | 11/1966 | Trexler | 9/39 |

*Primary Examiner*—Trygve M. Blix
*Assistant Examiner*—D. W. Keen
*Attorney, Agent, or Firm*—Harry F. Pepper, Jr.

[57] ABSTRACT

An inflatable raft in the deflated condition is stowed in a container attached to a platform adjacent a launching davit. The raft has a girt releasably connected to the container for stabilizing the raft during inflation and loading. The edges of the platform are positioned adjacent the davit for further stabilization of the raft. A sequential release mechanism is interconnected with the girt connection to the container and the brake of the supporting cable for the raft to insure release of the girt connection before the raft is lowered and thereby avoid upsetting the raft.

14 Claims, 5 Drawing Figures

FIG. 1
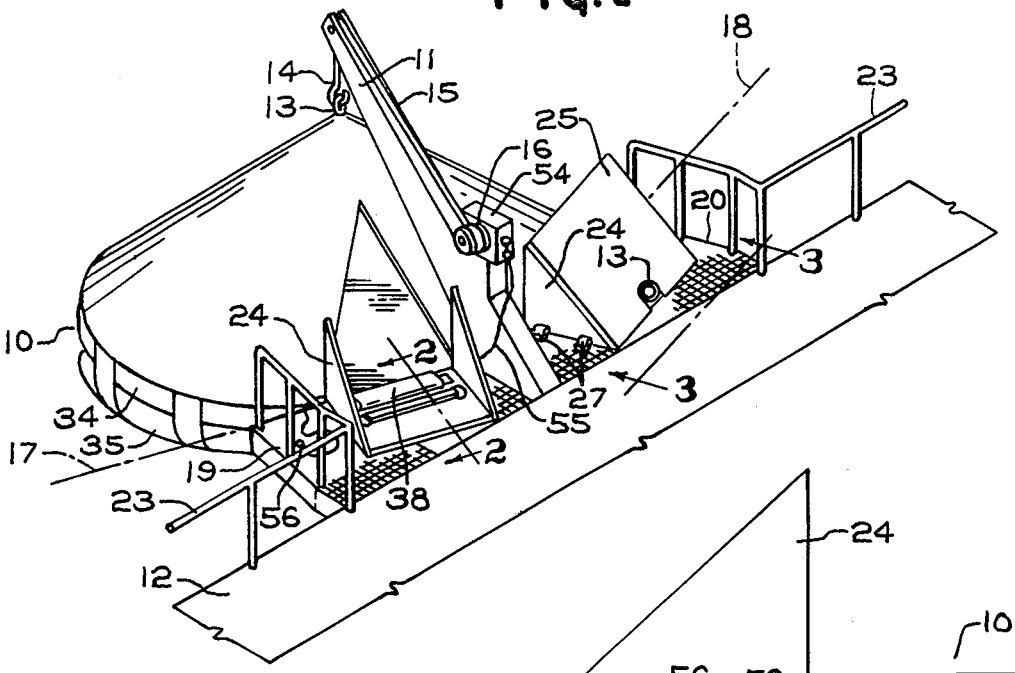
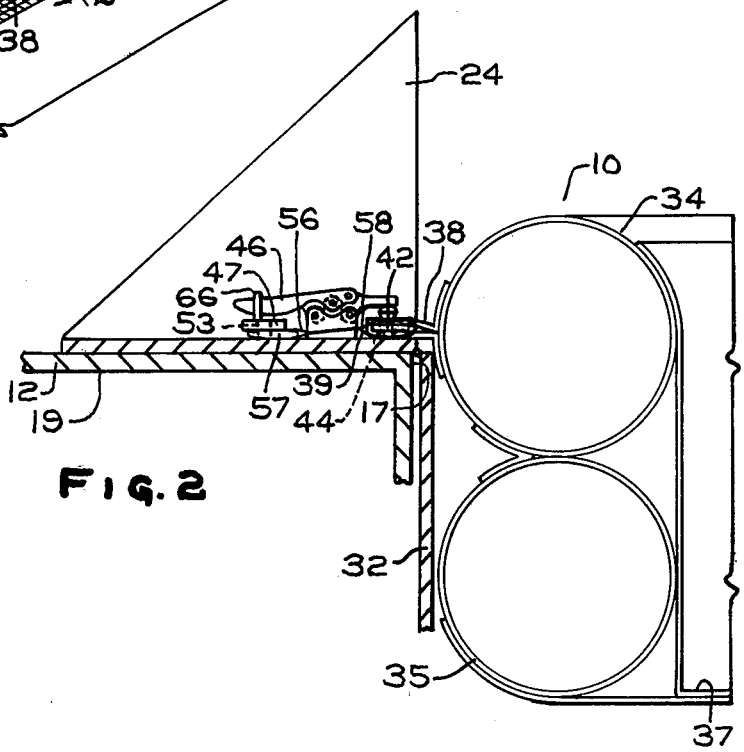
FIG. 2
FIG. 3
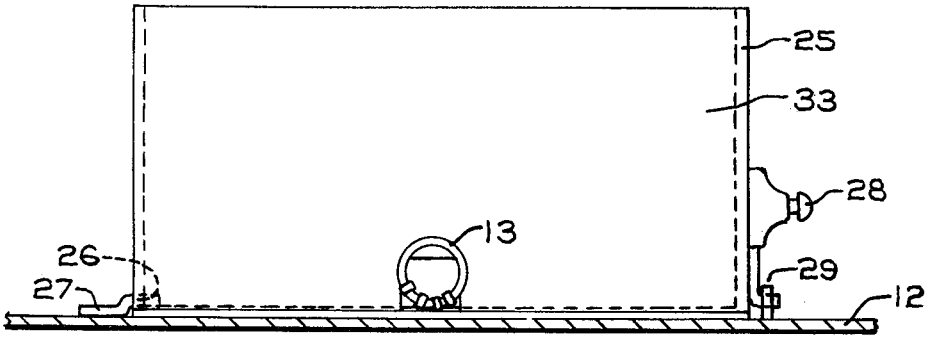

LAUNCHING SYSTEM FOR INFLATABLE RAFT

BACKGROUND OF THE INVENTION

This application is a continuation-in-part of U.S. Pat. application Ser. No. 777,501, filed Mar. 14, 1977, now abandoned.

This invention relates to collapsible passenger escape equipment and especially to the launching of inflatable rafts supported by a davit and lowered from an elevated platform or deck to the water.

This type of escape equipment is useful for evacuating people from offshore oil production platforms in the event of fire or other emergency. It is also useful for evacuating people from ships at sea.

At the present time, the inflatable rafts are packed in valise-type containers and stowed in the general vicinity of the launching davit. In the case of an emergency, they must be moved to the launch site and the fall or supporting cable attached to the raft lift ring after which the raft is inflated. Then an apron may be drawn out and over the raft onto the deck and attached by lines to cleats on the deck to stabilize the raft during loading. An example of this type of raft is shown in U.S. Pat. No. 2,970,324 of Phillips, dated Feb. 7, 1961.

One of the disadvantages of prior systems is the time required to move the raft in the container to the launch site and connect the supporting cable and apron lines. A problem with these systems is making sure the apron lines are released before the raft is lowered so that these lines will not cause tilting and spill out the passengers. When the raft is being handled under emergency conditions such as an oil or gas fire, these problems of setup time, stabilization and release of the apron lines may be the difference between a successful or unsuccessful launching of the raft and could cost the lives of the people who are depending on this mode of escape.

SUMMARY OF THE INVENTION

It is a principal object of this invention to provide an improved launching system for a collapsible passenger escape conveyor.

Another object of this invention is to provide a safe releasable connection between the conveyance and the loading platform to stabilize the conveyance during loading.

A further object of this invention is to provide a quick release of the connection between the conveyance and the loading platform prior to lowering of the conveyance to avoid spilling the occupants.

A still further object is to provide for stowing the collapsible conveyance adjacent the launching davit in a container adapted to quickly release the conveyance for expansion into the inflated loading condition.

Another object of this invention is to provide for release of the conveyance from the platform and lowering of the conveyance by action of a person in the conveyance.

A further object of this invention is to provide a platform edge configuration adjacent the launching davit for stabilizing the conveyance during loading.

A still further object is to provide for replacement of an empty container with a full container for utilize the launching davit for several collapsible conveyances.

These and other objects which will become apparent from the following description are achieved by stowing an inflatable raft in a container positioned adjacent a launching davit at the edge of a platform. The raft has a connecting apron or girt releasably connected to the container in the stowed condition for stabilizing the raft during inflation and loading. The edges of the platform are set at angles to further stabilize the conveyance during loading. After loading, the last man ro board the raft can actuate a sequential release which prevents release of the brake for the supporting cable before the apron is disconnected from the platform so that the raft will not be lowered prematurely and spill out the passengers.

BRIEF DESCRIPTION OF THE DRAWINGS

In the drawings:

FIG. 1 is a view in perspective of the launching system mounted on a platform with parts of the platform and retaining rail broken away.

FIG. 2 is an enlarged fragmentary sectional view taken along the plane of line 2—2 in FIG. 1.

FIG. 3 is a side view of the container in the closed condition taken along the plane of line 3—3 in FIg. 1.

DETAILED DESCRIPTION

Figure 5:
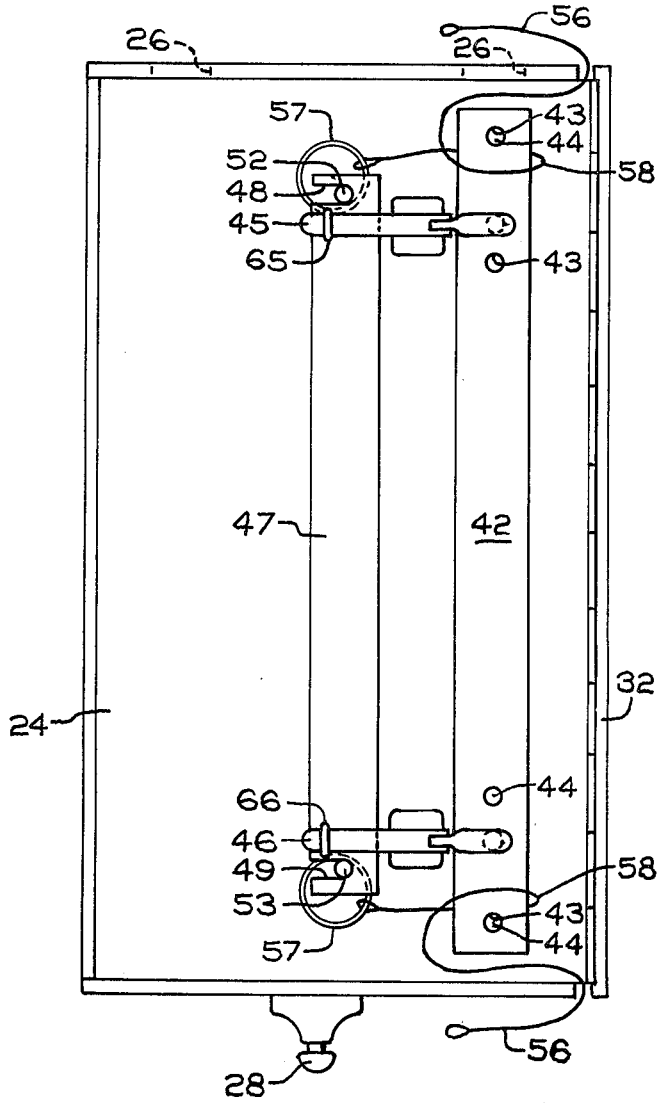
FIG. 5 is a plan view of the container in the open condition without the girt showing the attachment of the girt bar to the container base.
Figure 4:
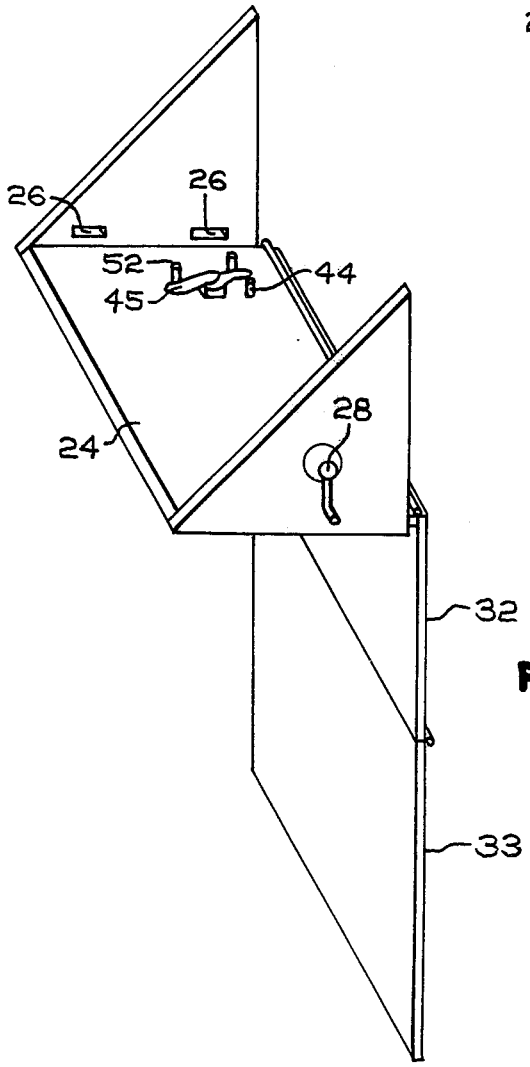
FIG. 4 is a schematic view in perspective of the container in the open condition without the girt bar.

Referring to FIG. 1, a launching system for a collapsible passenger escape conveyance such as an inflatable raft 10 is shown with the raft inflated and hanging from an overhead supporting member such as the davit 11 mounted on an elevated platform 12 such as the deck of an oil rig or the deck of a ship. The davit 11 extends upwardly and away from the platform 12 so as to support the raft 10 in a position for loading. The raft 10 has a shackle 13 which is connected through a suitable quick-release hook mechanism 14 to a fall or cable 15 which extends over a pulley at the end of the davit 11 to a winch 16 for raising and lowering the raft.

The platform 12 may have at least two edges 17 and 18, shown in dot-dash lines in FIG. 1, which are at an angle to provide a recess adjacent the davit 11 in which the raft 10 is positioned in the inflated condition. These edges 17 and 18 are on extensions such as wing member 19 and wing member 20 of the platform 12. Retaining rails 23 may be provided along the sides of the wing members 19 and 20 and the platform 12 as shown in FIG. 1.

Containers 24 and 25 which may be indentical in construction are releasably mounted on the wing members 19 and 20 by suitable means for ease of attachment to the platform and ease of removal so that the containers may float free or meet the safety requirements for throwing the containers overboard. The following description will be directed to one container 24 on wing member 19; however, it will also apply to container 25 on wing member 20. In the present embodiment, container 24 has handholds 26 at one end for sliding engagement with straps 27 which may be welded to the wing member 19 of platform 12. At the other end of the container 24, a hydrostatic release mechanism 28 is connected to a lug 29 fastened to the platform 12.

The raft 10 is stowed in the container 24 in the deflated condition. The container 24 has hinged sides 32 and 33 for covering and protecting the raft 10 in the stored condition. The shackle 13 extends outwardly through an opening in the hinged side 33 and may be attached to the hook mechanism 14 and cable 15. When it is desirable to use the raft 10, the winch 16 is turned and the raft is pulled out of the container 24 at which time the valve (not shown) for inflating the raft is actuated providing communication from a suitable source of air or gas (not shown) to the inflatable chambers of the raft. Simultaneously the hinged sides 32 and 33 swing downward along the side of the platform 12 and wing member 19.

As shown in FIGS. 1 and 2, the raft 10 has inflatable tubular members 34 and 35 at the sides which are connected together and to a canopy 36 and floor 37 of the raft. A girt or apron 38 is adhered to the upper tubular member 34 of the raft 10 and has a loop 39 through which a girt bar 42 extends. As shown in FIG. 5, the girt bar 42 has holes 43 for receiving pins 44 extending upwardly from the floor of the container 24. The girt bar 42 is held in an apron-retaining position by a releasable clamping mechanism such as toggle clamps 45 and 46 mounted on the floor of the container 24 at each end of the bar and having handles overlying an actuating rod 47 with slots 48 and 49 at each end for receiving pins 52 and 53 extending upwardly from the floor of the container. The handles of clamps 45 and 46 are connected to actuating rod 47 by U-bolts 65 and 66 respectively , which U-bolts are secured by nuts (not shown).

In loading the raft 10, the passengers step on the floor of the container 24 between the sides and over the apron 38 into the raft. When the last passenger has stepped into the raft 10, it is important that the apron 38 be released first and then the raft lowered on the cable 15 at a controlled rate. In the present embodiment, the winch 16 is mounted on a gear box 54 containing a brake for preventing turning of the winch during the loading operation and a governor to lower the raft 10 at a predetermined rate when te brake is released. A brake release line 55 extends from the gear box 54 and is connected to a release cable 56 leading into the container 24 and to a ring 57 positioned around pin 53 and under the end of the actuating rod 47. Between the ring 57 and the end of the release cable 56 attached to the brake release line 55, the release cable is attached to the end of the girt bar 42 by a loop 58 extending around the end of the girt bar 42 as shown in FIG. 5.

With this construction, the release cable 56 which is in the closest proximity to the davit 11 is connected to the brake release line 55. Then when the last passenger enters the raft 10, he can reach around and pull the ring 57 which will lift the actuating rod 47 and the connected handles of the toggle clamps 45 and 46 thereby releasing the girt bar 42. Upon further pulling of the ring 57, the girt bar 42 will be pulled off the pins 44 and the apron 38 will be released from the container 24. Additional pulling of the ring 57 will tension the brake release line 55 and release the brake permitting the cable 15 to lower the raft 10 to the water.

When the raft 10 reaches the water, the quick-release hook mechanism 14 may be actuated and the cable 15 will be released from the raft at the shackle 13. The cable 15 may then be raised by turning the winch 16 and when it has reached the proper height, the hook mechanism 14 can be attached to the shackle 13 of the raft 10 in container 25 on the other side of the davit 11. The brake release line 55 is also disconnected from the release cable 56 of container 24 and attached to the release cable 56 of container 25. The raft 10 in the container 25 can then be pulled out and loaded in the same manner as the raft in container 24.

The empty container 24 may be released from the wing member 19 of the platform 12 by manually actuating the hydrostatic release mechanism 28 and pulling the container off the straps 27. When this is done, another container with a raft stowed therein can be mounted on the wing member 19. After the raft 10 in container 25 has been removed from the container, inflated and launched, the cable 15 can be raised and fastened to the shackle 13 of the raft in the replacement container on wing member 19. Also the release cable 56 of the replacement container is attached to the brake release line 55.

Although two containers are shown on two wing members 19 and 20 for the embodiment described, it is understood that this invention is applicable also to systems with only one container and one wing member or there may be more than two containers at more than two positions along the edge of the platform 12. As seen in FIG. 5, the release cables 56 extend from either end of the container 24 and therefore the container can be mounted at either side of the davit 11 and the brake release line 55 connected to the release cable in closest proximity to the davit.

The invention is capable of other modifications and adaptions by those having ordinary skill in the art and is more particularly defined by the appended claims.

We claim:

1. A launching system for a collapsible passenger escape conveyance supported on an elevated platform comprising an overhead supporting member, an apron on said conveyance, a releasable connecting means between said apron and said platform for stabilizing said conveyance during loading, a cable member connected to said conveyance and to said overhead supporting member for supporting said conveyance in a loading position and lowering said conveyance after loading, cable control means engageable with said cable member for lowering and braking said cable member and sequential release means operatively connected to said cable control means and to said connecting means between said apron and said platform, said sequential release means being inoperative to release the brake of said cable control means until said apron is disconnected from said platform to avoid tilting of said conveyance during lowering from the loading position.

2. A launching system according to claim 1 wherein said escape conveyance is an inflatable raft which is stowed on said platform in the deflated condition and inflated in the loading position.

3. A launching system according to claim 1 wherein said raft is stowed in a container attached to said platform, said releasable connecting means between said apron and said platform including a bar operatively associated with said apron and releasably fastened to said container and said sequential release means including means for detaching said bar from said container before said cable control means brake is released.

4. A launching system according to claim 3 wherein said bar is held in an apron retaining position by a releasable clamping mechanism and said sequential release means includes a manual release of said clamping mechanism.

5. A launching system according to claim 4 wherein said manual release includes a release cable having a ring at one end and extending from said ring to said clamping mechanism, said release cable further extending from said clamping mechanism to said cable control means so that pulling of said ring releases said clamping mechanism first and then releases the brake of said cable control means.

6. A launching system according to claim 5 wherein said bar is fastened to said release cable between said cable control means and said clamping mechanism so that said bar will be pulled away from said container before the brake of said cable control means is released.

7. A launching system according to claim 6 wherein said clamping mechanism is a toggle clamp mounted on said container for holding said bar in position during loading of said conveyance and releasing said bar when said release cable connected to said toggle clamp is pulled.

8. A launching system according to claim 3 wherein said container has hinged panel members positioned over said deflated raft, said cable member is connected to said raft, said panel members being released from the position over said raft upon pulling of said raft out of said container by said cable, and means for inflating said raft after it is removed from said container while maintaining a stabilizing connection between said apron and said container on said platform.

9. A launching system according to claim 3 wherein said container is releasably mounted on said platform so that replacement containers containing deflated rafts can be substituted for said container after inflation, loading and lowering of said inflatable raft.

10. A launching system according to claim 1 wherein said overhead support includes a davit extending away from said platform, said platform having at least two edges engageable with the sides of said conveyance and said edges being at an angle to provide a recess adjacent said davit in which said conveyance is held for stabilization during loading.

11. A launching system according to claim 10 wherein one of said edges is on a wing member of said platform, said wing member projects outwardly from the main body of said platform.

12. A launching system according to claim 11 wherein said container is mounted on said wing member.

13. A launching system according to claim 11 wherein another of said edges is on another wing member of said platform projecting outwardly from the main body of said platform.

14. A launching system according to claim 1 wherein said cable control means includes a brake and a governor for automatically lowering said conveyance at a predetermined rate after release of said brake.

* * * * *

UNITED STATES PATENT AND TRADEMARK OFFICE

CERTIFICATE OF CORRECTION

PATENT NO. : 4,129,910

DATED : December 19, 1978

INVENTOR(S) : David V. Edwards; Harvey B. Lesh, Jr.; Ronald W. Phillips,II; Robert A. Willgohs It is certified that error appears in the above-identified patent and that said Letters Patent are hereby corrected as shown below:

The following name and address should be added to the "Inventors" listed on the Title Page of the subject patent:

--Robert A. Willgohs, N. Canton, Ohio--

Signed and Sealed this

*Eighth* Day of *May 1979*

[SEAL]

*Attest:*

RUTH C. MASON
*Attesting Officer*

DONALD W. BANNER
*Commissioner of Patents and Trademarks*